United States Patent [19]

Niemann

[11] Patent Number: 4,681,224

[45] Date of Patent: Jul. 21, 1987

[54] FLORIST'S IMPLEMENT

[75] Inventor: Ludwig C. Niemann, 1543-D Coleman Rd., Knoxville, Tenn. 37909

[73] Assignees: Gerald R. McCully, Tucson, Ariz.; Ludwig C. Niemann, Knoxville, Tenn.

[21] Appl. No.: 938,158

[22] Filed: Dec. 4, 1986

[51] Int. Cl.[4] ..... B65D 85/50

[52] U.S. Cl. ..... 206/423; 206/426; 206/45.14; 206/489; 248/152

[58] Field of Search ..... 206/423, 426, 45.14, 206/486, 488, 489; 248/152

[56] References Cited

U.S. PATENT DOCUMENTS

| | | | |
|---|---|---|---|
| 3,881,674 | 5/1975 | Greene, III | 206/423 |
| 4,078,658 | 3/1978 | Neiser | 206/423 |
| 4,204,598 | 5/1980 | Adams | 206/426 |
| 4,248,347 | 2/1981 | Trimbee | 206/423 |
| 4,304,328 | 12/1981 | Pilat | 206/426 |

*Primary Examiner*—Joseph Man-Fu Moy
*Attorney, Agent, or Firm*—James H. Phillips

[57] ABSTRACT

A florist's implement for temporarily stabilizing a flower or plant container or the like during transport is disclosed. The implement includes first and second square sheets of a flexible material hingedly connected to one another such that the sheets may be folded into superimposed juxtaposition to provide upper and lower sheets. The upper sheet is provided, on its upper face, with a series of scores in a predetermined pattern. There is first arranged a grid of scores equally spaced between and parallel to the square edges to obtain an array of squares. The number of scores is selected to obtain a junction of two mutually perpendicular scores at the center of the square sheet. The single central score which is directed generally normal to the hinge side of the sheet is heavier than the scores to which it is parallel and perpendicular and is sufficiently heavy as to permit ready manual separation along its length by hand. Additional scores are provided across the diagonal dimensions of the four inner-most squares of the grid of squares, and these diagonal scores are also cut more heavily than those establishing the grid in order to permit ready manual removal of the diamond shaped area defined by these diagonal scores. This configuration permits the separation of the two halves of the upper sheet and the removal of the skewed central square area and the subsequent manipulation of the resulting generally rectangular square halves along the more lightly scored regions to establish a shape appropriate to situate and stabilize the base of a container. The container is then securely clasped in place when staples are inserted (or adhesive or other fixing means employed) to bind the upper and lower sheets together. As a result, a very broad base is temporarily established to stabilize the container during transport.

7 Claims, 32 Drawing Figures

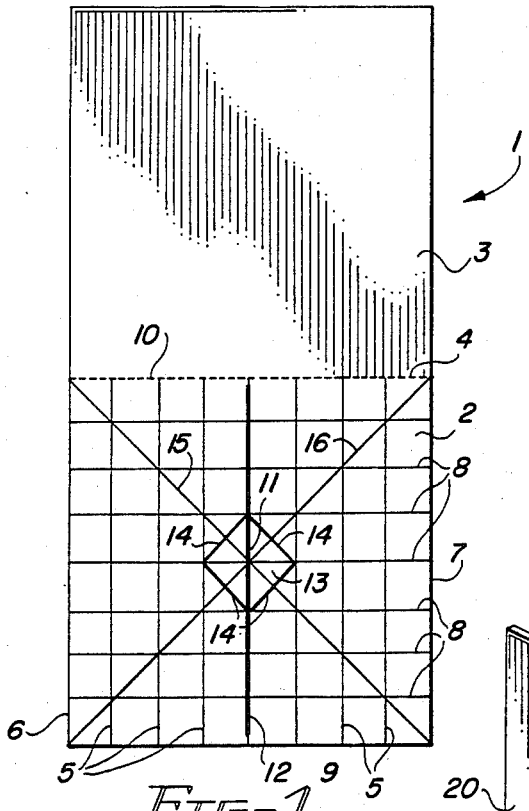
FIG. 1
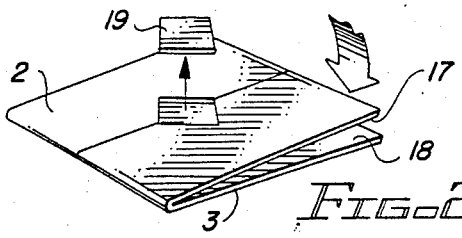
FIG. 2A
FIG. 2B
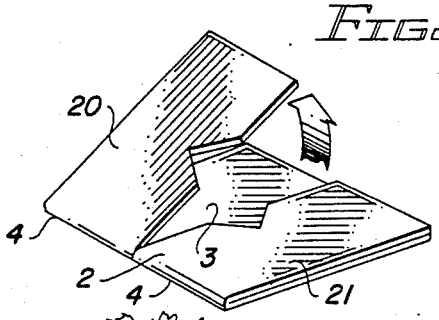
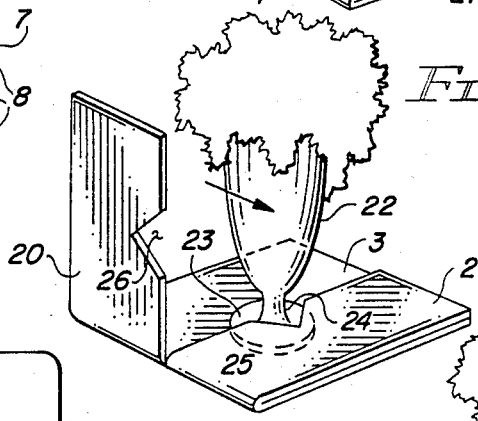
FIG. 2C
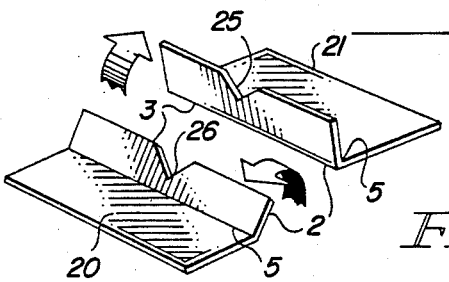
FIG. 3A
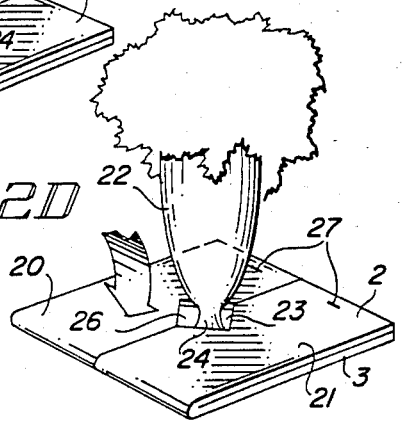
FIG. 2D
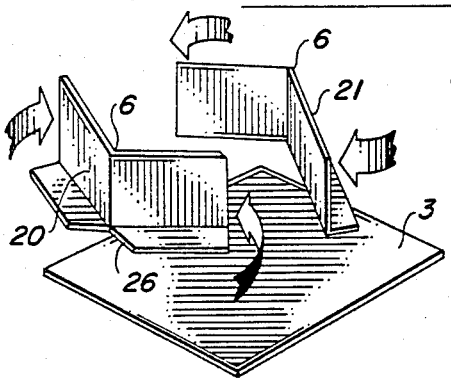
FIG. 3B
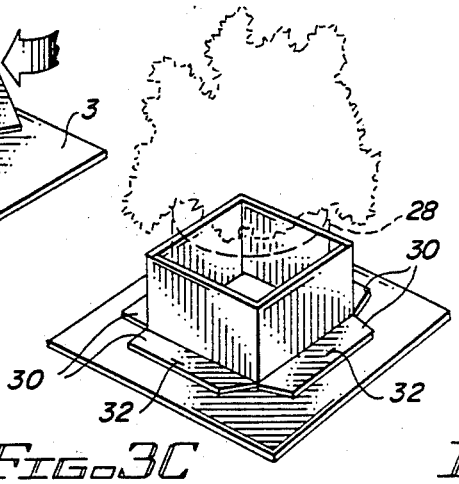
FIG. 3C
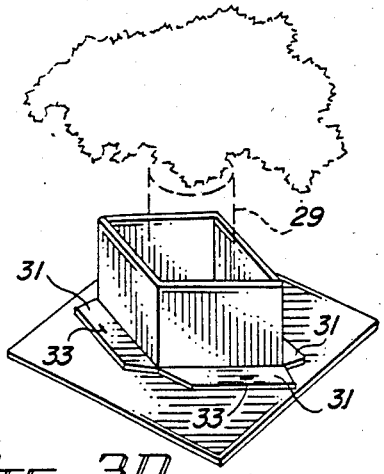
FIG. 3D

FLORIST'S IMPLEMENT

FIELD OF THE INVENTION

This invention relates to the packaging arts and, more particularly, to a florist's implement for temporarily providing supplementary stability to vases and other containers for flowers and plants during transport.

BACKGROUND OF THE INVENTION

When flowers are purchased at a commercial florist's establishment, they are often packaged in a vase which may range in character from a plastic "throw-away" type (intended only for transport of the flowers to the intended recipient) to vases of glass, ceramic, etc. which may have a substantial intrinsic value of their own. A common problem associated with the sale and transport of flowers contained in such vases is their very poor stability; i.e., the vases are typically relatively tall and slender with narrow bases. While this presents an attractive appearance when situated on an immovable surface, considerable difficulty is encountered in transporting such a package. There is therefore a need for temporarily stabilizing such containers during transport. Such need may be encountered, for example, in conveying flowers in a delivery truck or, particularly, in a personal car. In addition to the possibility of damaging the flowers and the vehicle interior (as by water spillage), there is also the potential for dangerously distracting the driver who tends to reach for a container if it should be peripherallyobserved to be tipping over.

Similarly, potted plants are often emplaced in containers which are somewhat top heavy and, while not as unstable as flowers disposed in a tall, slender vase, they are nonetheless prone to tip over or slide around during transport, particularly in a personal automobile.

Therefore, those skilled in the art will readily appreciate that there has been a long standing need for an efficient means to reliably provide temporary stability to such floral and plant containers in order that they can be safely transported to their destination without fear of their tipping over. It is to this end that my invention is directed.

OBJECTS OF THE INVENTION

It is therefore a broad object of my invention to provide reliable means for temporarily stabilizing an inherently unstable container, such as a vase, during transport.

It is another object of my invention to provide such a stabilizing means which may be employed as an accessory by a florist.

In another aspect, it is an object of my invention to provide such a stabilizing means which is versatile and may be readily accommodated to a large variety of differing container configurations.

It is yet another object of my invention to provide such a stabilizing means which is economical to fabricate.

It is still yet another object of my invention to provide such a stabilizing means which is very simple to use and adapt to diverse configurations suitable for use with a wide variety of containers to be stabilized.

SUMMARY OF THE INVENTION

Briefly, these and other objects of my invention are achieved by providing a florist's implement which includes first and second square sheets of a flexible material hingedly connected to one another such that the sheets may be folded into superimposed juxtaposition to provide upper and lower sheets. The upper sheet is provided, on its upper face, with a series of scores in a predetermined pattern. There is first arranged a grid of scores equally spaced between and parallel to the square edges t obtain an array of squares. The number of scores is selected to obtain a junction of two mutually perpendicular scores at the center of the square sheet. In addition, first and second diagonal scores are optionally provided between the right angle junctions of the sheet sides, the diagonal scores therefore also intersecting at the sheet corner. The single central score which is directed generally perpendicular to the hinge side of the sheet is heavier than the scores to which it is parallel and perpendicular and is sufficiently heavy as to permit ready manual separation along its length by hand. Additional scores are provided across the diagonal dimensions of the four inner-most squares of the grid of squares, and these diagonal scores are also cut more heavily than those establishing the grid in order to permit ready manual removal of the diamond shaped (skewed square) area defined by these diagonal scores. This configuration permits the separation of the two halves of the upper sheet and the removal of the skewed central square area and the subsequent manipulation of the resulting generally rectangular square halves by folding along the more lightly scored regions to establish a shape appropriate to situate and stabilize the base of a container. The container is then securely clasped in place when staples are inserted (or adhesive or other fixing means employed) to bind the upper and lower sheets together. As a result, a very broad base is temporarily established to stabilize the container during transport. The base is readily removed and discarded once the container's destination has been reached.

DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a plan view of the florist's implement of the present invention illustrated in its typical manufactured state as supplied to a florist;

FIGS. 2A–2D illustrate the steps of use in adapting the subject florist's implement to a first type of container to carry out its intended temporary stabilization purpose;

FIGS. 3A–3D illustrate the steps of use in adapting the subject florist's implement to a second type of container

DETAILED DESCRIPTION OF THE INVENTION

Figure 4A:
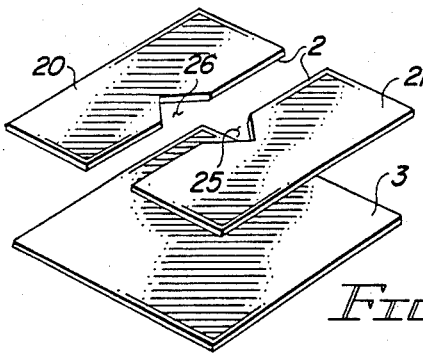
FIGS. 4A and 4B illustrate the steps of use in adapting the subject florist's implement to a third type of container which is particularly characterized by a very narrow neck immediately above its base.

Attention is now directed to FIG. 1 which is a plan view of a florist's implement 1 according to the present invention. The florist's implement 1 includes first and second square sheets 2,3, respectively, the two sheets being manually detachably secured together along a hinge 4. As will be discussed more completely below, several materials are appropriate for fabricating the florist's implement 1. In addition, the term "score" as used herein may mean slightly differing types (appropriate to the material used) of intentional "weakness" provided along a given line for either facilitating bending or separation along that line. However, for purposes of explanation, corrugated cardboard may be taken as exemplary and is one presently preferred material. Thus, the hinge 4 may be effected by a deep score which reaches nearly through the thickness of the implement 1 at the hinge line in order to permit the second square sheet 3 to be folded beneath the first square sheet 2 which, as will be explained more fully below, is a first step in preparing the subject florist's implement for use. Various dimensions for the square sheets 2,3 are contemplated; for example, twelve inches by twelve inches has been found to be a versatile size However, both larger and smaller implements also find use, and a well-stocked florist's shop could usefully have implements with side dimensions of in the range of eight to sixteen inches on hand.

The first square sheet 2 is provided with a grid of scores (i.e., cuts, perforations, or the equivalent) on its upper face. The grid of scores includes a first series of equally spaced scores 5 distributed between first and third edges 6,7, respectively, on the upper face of the first square sheet 2 and a second series of equally spaced scores 8 distributed between the second and fourth sides 9,10, respectively. (It will be noted that the fourth edge 10 of the sheet 2 is at the hinge 4.) With a single exception to be discussed below, the scores 5,8 are rather "light" (e.g., penetrating only the upper surface of the corrugated cardboard) and are provided to facilitate bending, rather than separation, along their lengths.

The number of scores 5,8 in the two mutually perpendicular series are each an odd number such that one central score in each series passes through the center point 11 of the first sheet 2. A presently preferred number of scores in each direction is seven as shown in FIG. 1 to define an eight-by-eight array of square areas. The central score 12 from among the first series 5 is cut or perforated more deeply than the remainder of the scores 5,8, and the extent of its scoring is made sufficient as to permit ready manual separation of the upper sheet 2 into halves along its length.

Because of the odd number of scores 5,8, the grid of squares includes a central group 13 of four squares which meet at the center point 11 of the upper square sheet 2. Four heavy scores 14 are provided along diagonal dimensions of the central group 13 of four squares to define a diamond shaped area, and the scores 14 are sufficiently deep as to permit ready "punching out" of the area defined by them. The heavy scores 14 may extend between (but not outwardly beyond) opposite corners of each of the central group 13 of four squares or they may be placed somewhat closer to the center point 11 as shown in FIG. 1.

Optionally, first and second diagonal scores 15,16, respectively, may be provided between opposing corners of the upper square sheet 2. The diagonal scores 15,16 thus intersect perpendicularly at the central point 11 of the upper sheet 2. These scores are "light" and intended to delineate optional bending lines which extend the versatility of the subject florist's implement.

Attention is now directed to FIGS. 2A–2D which illustrate sequential steps which may be taken to utilize the subject florist's implement to support a vase with flowers or other plants which is somewhat top heavy. Referring first to FIG. 2A, the first sheet 2 and the second sheet 3 are folded into juxtaposition with their respective lower faces (as laid out in FIG. 1) 17,18 disposed in face-to-face relationship. The diamond shaped piece 19 (which is defined by the heavy diagonal scores 14 shown in FIG. 1) is manually popped out of the center of the first square sheet 2. Next, as shown in FIG. 2B, the upper square sheet 2 is separated into two mirror image rectangular halves 20,21 by manually parting them along the heavy central score 12 (FIG. 1). Thus, each of the sheet halves 20,21 may be individually pivoted about the hinge area 4. Then, as shown in FIG. 2C, a vase 22 having a flanged based 23 from which a neck 24 extends upwardly may be slid into the notch 25 formed in the detached half 21 of the sheet 2 as a result of removing the diamond shaped piece 19. Finally, as illustrated in FIG. 2D, the remaining half 20 of the sheet 2 is folded downwardly such that the notch 26 (the other half of the area exposed by the removal of the diamond shaped piece 19) overlays the base 23 of the vase 22. As a result, the narrow neck 24 of the vase extends through the notch pair 25,26, and the base 23 is captured between the sheets 2,3. In order to retain the halves 20,21 of the sheet 2 in this position, staples 27 may be used to secure the ends away from the hinge area. Alternative securement means, such as adhesive, can be employed in place of the staples 27. For example, the florist's implement may be supplied with pressure sensitive adhesive emplaced at the mating surfaces to obviate the necessity for using staples or other separate fixing means.

FIGS. 3A–3D illustrate the manner in which the florist's implement of the present invention can be adapted to providing temporary stability to plants in containers which are more or less cylindrical; i.e., which do not have a distinct base from which a narrow neck extends upwardly. As shown in FIG. 3A, the upper sheet 2 (after it has first been detached from the lower sheet 3 along the hinge area 4—FIG. 1) is separated into its two halves by parting it along the heavy central score 12 (FIG. 1). Notches 25,26 are obtained by removal of the diamond shape piece 19 (FIG. 2A). Then each half 20,21 is folded along the one of the scores 5 beneath the respective notches 25,26 into the form shown in FIG. 3A. Now, referring to FIG. 3B, the halves 20,21 are inverted and folded along the specific scores 6 which intercept the inside corners of the respective notches 26,25, and the thus developed halves 20,21 may be abutted to provide a square configuration (FIG. 3D) or a parallelogram configuration (FIG. 3D)

to contain and stabilize, respectively, a relatively large cylindrical container 28 and a moderately sized cylindrical container 29. The outwardly extending tab areas 30, 31 may then be secured in place by staples 32,33, by adhesive or by any other suitable means.

Figure 4B:
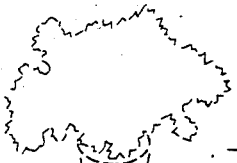

Consider now FIGS. 4A and 4B which illustrate the adaptation of the subject florist's implement to the temporary support of a vase 33 characterized by a very small neck 34. The first sheet 2 is completely separated from the second sheet 3 by detaching it along the hinge region as previously described. Next, as also previously described, the sheet 2 is divided into its two halves, 20,21 and the diamond shaped piece 19 is removed to obtain the intermediate stage illustrated in FIG. 4A. The manner in which the sheet halves 20,21 and the lower sheet 3 are coupled together to secure the narrow necked vase 33 is illustrated in FIG. 4B wherein the halves 20,21 have each been displaced inwardly until their notched areas 25,26 overlap to cooperatively define a sufficiently small opening to securely capture the narrow neck 34 of the vase 33. Staples 35 or other securement means may then be employed to maintain the juxtaposition of the three pieces as previously described.

Figure 5A:
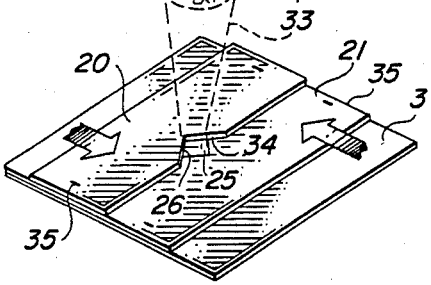
FIGS. 5A–5E illustrate the steps of use in adapting the subject florist's implement to a fourth type container.
Figure 5B:
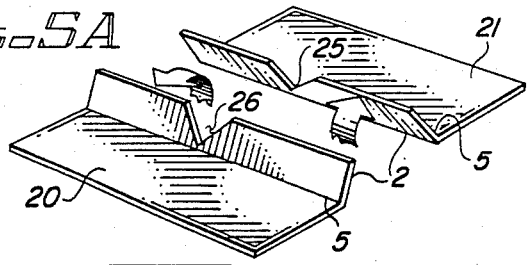
Figure 5B:
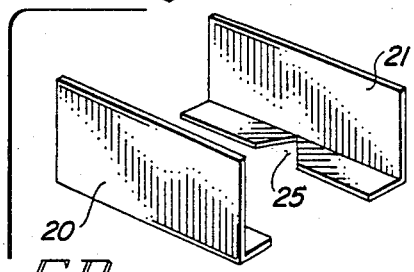
Figure 5C:
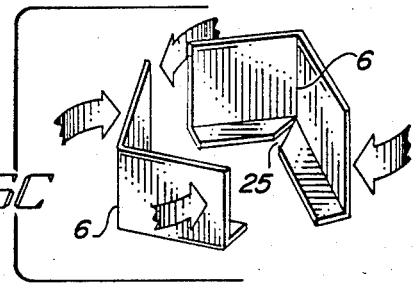
Figure 5D:
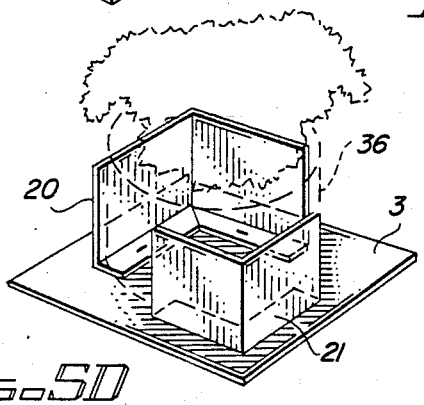
Figure 5E:
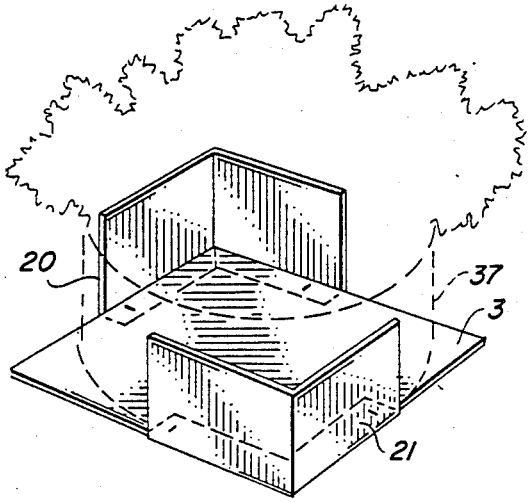

The florist's implement of the present invention is still further adaptable to provide stabilization against sliding to substantially larger cylindrical containers than those illustrated in FIGS. 3C and 3D. Thus, referring to FIG. 5A, the upper sheet 2 has been divided into the two halves 20,21 and separated from the lower sheet 3 and folded along the individual ones of scores 5 which intercept the respective tips of the notches 25,26. As shown in FIGS. 5B and 5C, the halves 20,21 are stood on their small edges, i.e., with the notches 25,26 horizontally disposed and facing in order that (as best shown in FIG. 5C) folds can made along the individual ones of scores 6 which intercept the notches 25,26 to obtain right angle "inner corner" configurations. Then, according to whether the plant container to be stabilized is very large 36 (FIG. 5D) or extra large 37 (FIG. 5E), the two halves 20,21 are positioned on the lower sheet 3 with their respective right angles generally in alignment with the right angles of the lower sheet 3 and stapled or otherwise fixed in position to embrace the respective containers 36,37.

Figure 6A:
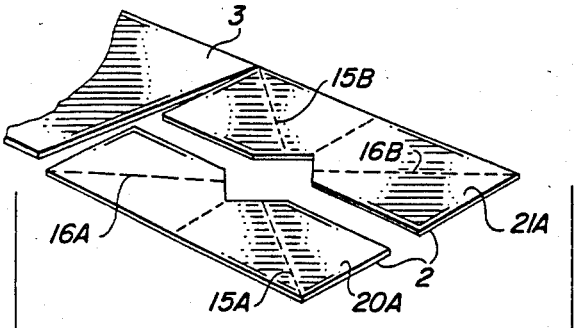
FIGS. 6A–6D illustrate the steps of use in adapting the subject florist's implement to a configuration that obtains a tent-like structure for supporting various objects.
Figure 6B:
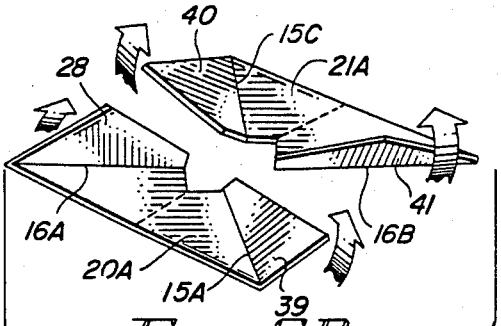
Figure 6C:
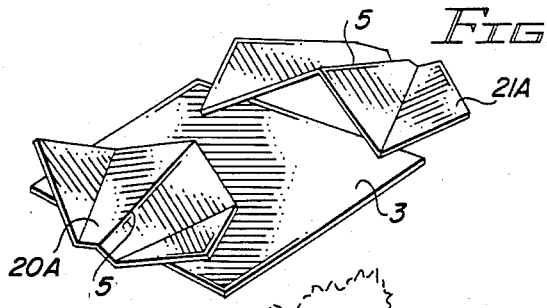
Figure 6D:
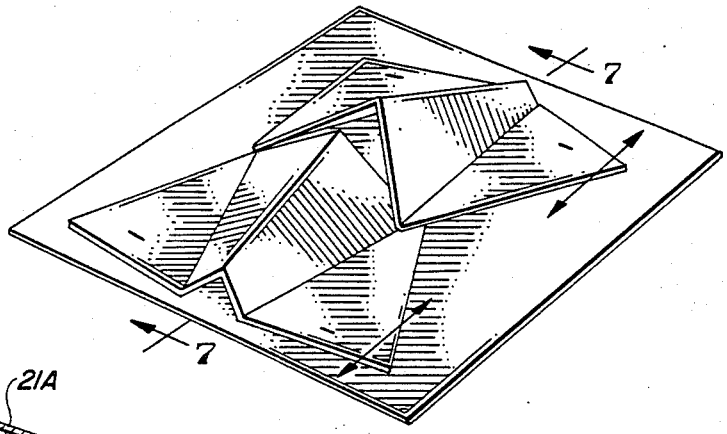

Various adaptations of the subject florist's implement have been described so far in configurations which do not require the use of the optional diagonal scores 15,16 shown in FIG. 1. Consider now, however, the use of the implement to provide containment and/or temporary stabilizing support to additional articles and/or containers through the selective use of the diagonal scores 15,16. As shown in FIG. 6A, the upper square sheet 2 is separated from the lower sheet 3 and is split along the heavy score 12 (FIG. 1); and the diamond shaped piece 19 (FIG. 2A) is removed (all as previously described) to obtain the working pieces **20*a*,21*a* which include diagonal folding scores 15*a*, 15*b*, 16*a*, 16*b*. Then, as shown in FIG. 6B, the outer edges 38,39 of working piece 20*a* and the outer edges 40,41 of working piece 21*a* are each folded upwardly along the respective diagonal regions 16*a*, 15*a*, 15*b*, 16*b*. Next, as may be seen in FIG. 6C, a fold in the opposite direction is made along the fold scores 5 which are central to each of the working pieces 20*a*,21*a* to obtain the pair of tent-like structures illustrated. Finally, as shown in FIG. 6D, the halves 20*a*,21*a* may be stapled or otherwise affixed to the lower sheet 3**to hold in place any article which can be contained in the interstitial space provided by the juxtaposition of the three pieces.

Figure 7:
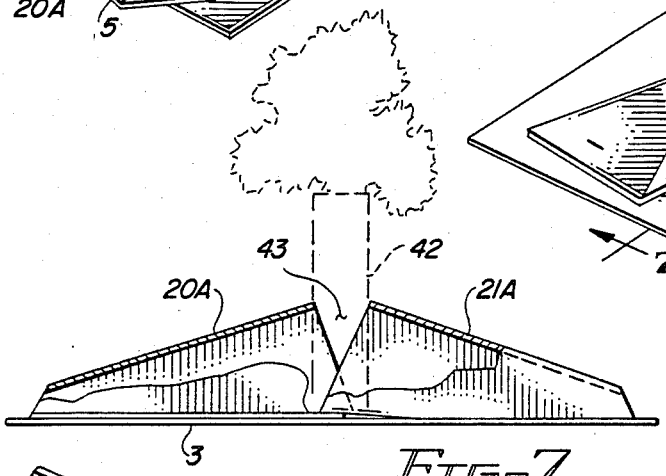
FIG. 7 illustrates the use of the configuration obtained by the steps shown in FIGS. 6A–6D to stabilize a fifth type of container which is particularly characterized by a tall, narrow cylindrical shape.

One particularly useful application of the florist's implement prepared in accordance with FIGS. 6A–6D is to provide support for a tall cylindrical container having a narrow diameter. Such a container 42 is illustrated in FIG. 7 securely stabilized and held in position by the two halves **20*a*,21*a* prepared as previously described and affixed to the lower sheet 3. Thus, the central opening 43 is made just sufficient to accommodate the container 42 by adjusting the mutual positions of the halves 20*a*,21*a* to closely engage the container 42 at a position well above its base which bears on the lower sheet 3**.

Figure 8A:
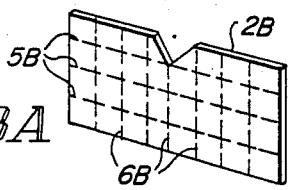
FIGS. 8A–8K illustrate a variant configuration of the subject packaging implement which is very broadly adaptable to establish a plurality of support configurations for stabilizing articles of numerous and diverse shapes.
Figure 8B:
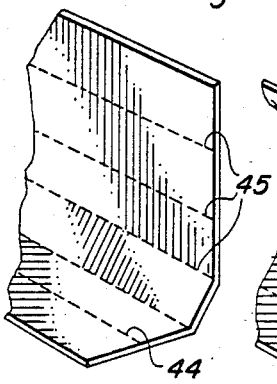
Figure 8C:
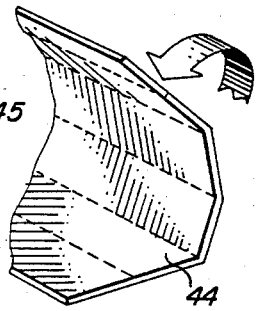
Figure 8D:
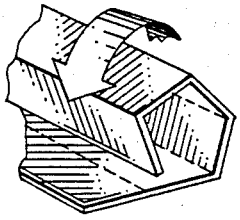
Figure 8E:
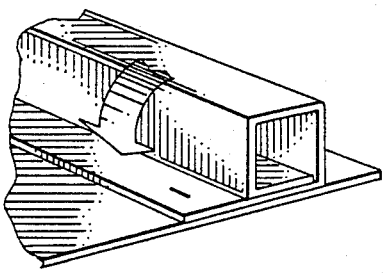
Figure 8F:
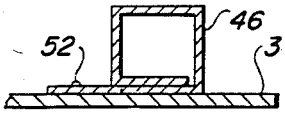
Figure 8G:
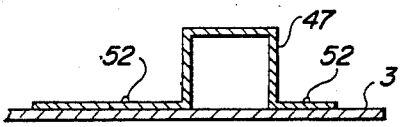
Figure 8H:
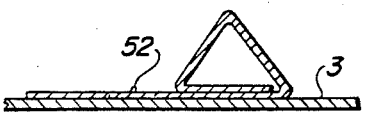
Figure 8I:
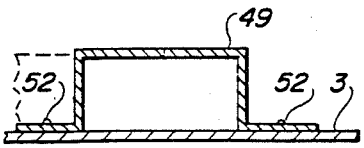

Referring now to FIG. 8A, further versatility is available by selective folding of the elements of the upper sheet **2*b* along the scores 5,6 and subsequently stapling or otherwise affixing the prepared structures to the lower sheet 3 to extend the useful scope of the subject invention beyond its illustrative use as a florist's implement. The folding scores 5*b*,6*b*, while still an odd number (across the full width of a square), are preferably eleven in number rather than seven. This obtains, in the square half illustrated in FIG. 8A**, a six-by-twelve array of defined square areas.

Figure 8J:
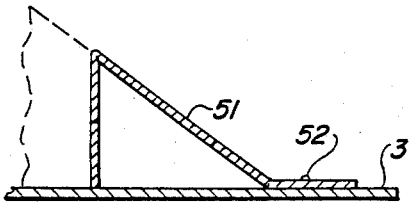
Figure 8K:
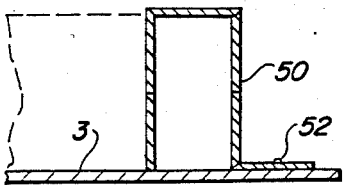

Thus, as variously shown in FIGS. 8B–8K a sheet half 44 of the scored sheet **2*b*, after separation from the lower sheet 3, may be variously folded along score lines 45 to obtain square cross sectional configurations (variants 46,47 shown in FIGS. 8B–F and 8G), an equilateral triangle (48 shown in FIG. 8H), rectangles (variants 40,50 shown in FIGS. 8I and 8K), and a right triangle (51 shown in FIG. 8J). Once the desired cross sectional form has been obtained by folding the sheet half 44 as desired, it may be emplaced at any appropriate position on the lower sheet 3 using staples 52**, adhesive or any other suitable affixing medium. By suitably adapting the implement components to a given article to be supported, a very wide variety of assembled packaging systems may be obtained.

It has been noted above that the florist's implement of the present invention is readily fabricated from a variety of materials in addition to the illustrative corrugated cardboard. Other suitable materials include: styrofoam, paper mache, molded plastic, fabricated plastic, fiberglass, plexiglass, chipboard (tablet-back type), corrugated liner board, masonite, and even wood and metal. It will be appreciated, therefore, that the term "score" as used herein must be interpreted appropriately for the actual material employed. Thus, a heavy score is an intentionally provided weakened linear run which admits of ready complete separation by hand while the other scores are linear runs of somewhat lighter weakness to facilitate and promote selective folding along their lengths. For some scores, perforations or interrupted cuts may be appropriate.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environmentsand operating requirements without departing from those principles.

I claim:

1. An implement for temporarily stabilizing a container comprising:

(A) first and second square sheets;

1. each said square sheet having upper and lower faces;
2. each said square sheet having first, second, third and fourth equal length edges;
   a. all said edges of said first and second sheets being the same length;
   b. said first and third edges of each said shet being parallel to one another;
   c. said second and fourth edges of each said sheet being parallel to one another;
   d. adjacent edges of each said sheet joining at right angles;

(B) means hingedly connecting said fourth edge of said first sheet with one edge of said second sheet such that said second sheet may be folded beneath said first sheet to bring said lower face of said second sheet into juxtaposition with said lower face of said first sheet;

(C) a grid of scores in said upper face of said first sheet, said grid of scores comprising:
1. a first series of a predetermined odd number of equally spaced scores arranged parallel to said first and third edges of said first sheet, the center one of said first series of scores passing through the center of said upper face of said first sheet, said center one of said first series of scores being a heavy score;
2. a second series of said predetermined odd number of equally spaced scores arranged parallel to said second and fourth edges of said first sheet, the center one of said second series of scores passing through the center of said upper face of said first sheet;

such that said upper face of said first sheet is divided by said first and second series of scores into an array of square areas, a central group of four of which square areas have respective corners meeting at the center of said upper face of said first sheet; and (D) first, second, third and fourth heavy scores in said upper face of said first sheet, said heavy scores extending, respectively, across diagonal dimensions of said central group of four square areas to define a diamond shaped area having its center at the center of said upper face of said first sheet.

2. The implement of claim 1 in which said heavy scores are sufficient as to permit the ready separation by hand of said diamond shaped area from said first sheet and the ready split by hand of said first sheet into rectangular sheet halves.

3. The implement of claim 2 in which all other scores are lighter than said heavy scores, but are sufficient to promote folding by hand along their respective lengths.

4. The implement of claim 3 which is fabricated from corrugated cardboard.

5. The implement of claim 3 which is fabricated from a material selected from among the group which includes: styrofoam, paper mache, molded plastic, fabricated plastic, fiberglass, plexiglass, chipboard, corrugated liner board, masonite, wood and metal.

6. The implement of claim 4 which further includes first and second diagonal scores in said upper face of said first sheet;

(A) said first diagonal score extending between the junctions of said first and fourth sides of said first sheet; and (B) said second diagonal score extending between the junctions of said second and third sides of said first sheet.

7. The implement of claim 5 which further includes first and second diagonal scores in said upper face of said first sheet;

(A) said first diagonal score extending between the junctions of said first and fourth sides of said first sheet; and (B) said second diagonal score extending between the junctions of said second and third sides of said first sheet.

* * * * *